United States Patent [19]

Dahl

[11] Patent Number: 4,468,287

[45] Date of Patent: Aug. 28, 1984

[54] BAND PRESS FOR A FIBER WEB

[75] Inventor: Hans Dahl, Ravensburg, Fed. Rep. of Germany

[73] Assignee: Escher Wyss GmbH, Ravensburg, Fed. Rep. of Germany

[21] Appl. No.: 330,677

[22] Filed: Dec. 14, 1981

[30] Foreign Application Priority Data

Jan. 27, 1981 [CH] Switzerland ..... 499/81

[51] Int. Cl.[3] ..... D21F 3/06; D21F 3/08

[52] U.S. Cl. ..... 162/358; 162/360; 162/361; 100/118; 100/121; 100/153; 100/154

[58] Field of Search ..... 162/205, 305, 360, 361, 162/358; 100/118, 153, 154, 121

[56] References Cited

U.S. PATENT DOCUMENTS

| | | | |
|---|---|---|---|
| 3,528,881 | 9/1970 | Steube | 162/358 |
| 3,783,097 | 1/1974 | Justus | 162/358 |
| 3,808,092 | 4/1974 | Busker | 162/305 |
| 3,853,698 | 12/1974 | Mohr | 162/358 |
| 3,970,515 | 7/1976 | Busker | 162/205 |
| 4,287,021 | 9/1981 | Justus et al. | 162/358 |

*Primary Examiner*—Steve Alvo

*Attorney, Agent, or Firm*—Werner W. Kleeman

[57] ABSTRACT

A band press for a fiber web contains a cylinder having a solid surface over which there is guided the fiber web, for instance a paper web, which experiences a pressing or squeezing action in conjunction with a felt or wire and a press band which is impervious for a pressurized fluid medium. To accomplish the pressing or contact action there is provided a press housing containing a plurality of pressure chambers or spaces for pressurized fluid medium and with such pressure chambers operating at different pressures. The paper web is guided in a manner such that it bears upon the surface of the cylinder. The press housing is provided at the location where there outbound or depart the bands with a sharp departure or runoff edge by means of which the bands are separated from the paper web which continues to remain at the cylinder.

4 Claims, 5 Drawing Figures

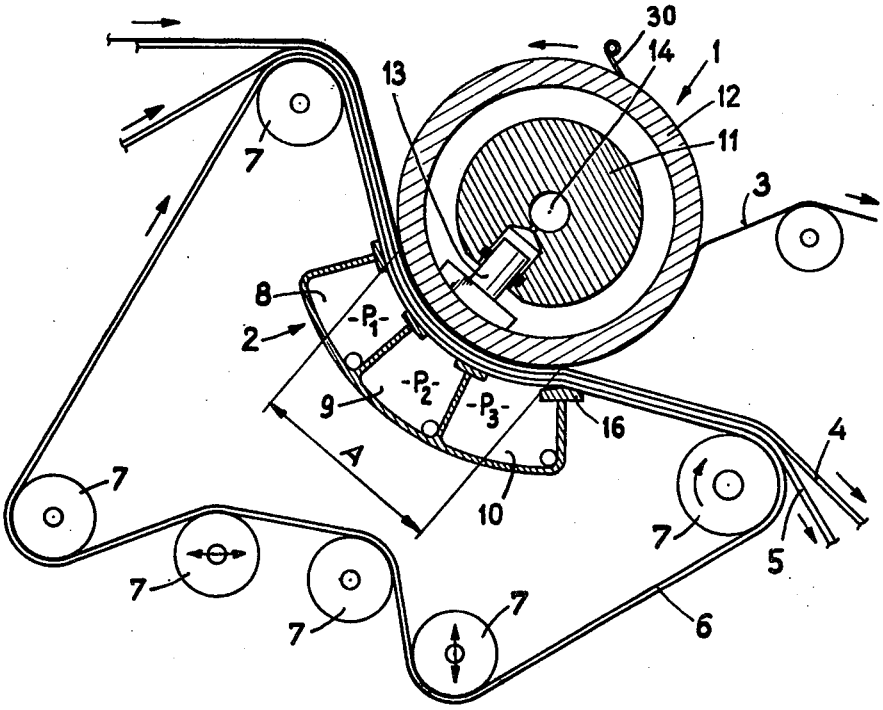

BAND PRESS FOR A FIBER WEB

BACKGROUND OF THE INVENTION

The present invention relats to a new and improved construction of band pressfor a fiber web, typically for instance a paper web, and is specially useful by way of example, although not limitation, in a papermaking machine.

Generally speaking, the band press of the present development is of the type containing a cylinder and a press housing which encircles a portion of the circumference of such cylinder. This press or contact housing is provided with a pressure chamber or space containing a pressurized fluid medium. A press zone is formed between the cylinder and the press or contact housing. The paper web which is to be dewatered together with at least one porous band suitable for taking-up the expressed water and a press band impervious to the pressurized fluid medium are guided through the press zone.

Band presses of the aforementioned type are well known in the art, for instance from U.S. Pat. No. 3,293,121 or German patent publication No. 2,313,920.

With the state-of-the-art band presses there prevails the appreciable drawback that following passage through the press zone between the cylinder and the press housing there arises a decisive rewatering or retro-watering of the paper web in that a portion of the previously pressed-out or expressed water flows back from the porous band into the paper web. This retrowatering action is predicated upon the fact that the paper web together with the porous band and the press band are guided, following the press zone, to a guide roll at the region of which there is then accomplished the separation of the individual webs and bands.

On the other hand, in both of these band presses there is used as the cylinder a suction roll. This suction roll is not very effective because of the use of the impervious press band, however precludes a positive guiding of the fiber web which, in turn, can lead to operational disturbances.

SUMMARY OF THE INVENTION

Therefore, with the foregoing in mind it is a primary object of the present invention to provide a new and improved construction of band press for a fiber web which is not afflicted with the aforementioned drawbacks and limitations of the prior art constructions.

Another and more specific object of the present invention aims at providing a new and improved construction of a band press which with increased operational reliability affords an improved dewatering action, and, on the one hand, specifically by accomplishing a positive band guiding action and, on the other hand, extensively avoiding the aforementioned recapture of the previously expressed liquid.

Still a further significant object of the present invention aims at providing a new and improved construction of a band press for a fiber web, which band press is relatively simple in construction and design, economical to manufacture, extremely reliable in operation, not readily subject to breakdown or malfunction, and requires a minimum of maintenance and servicing.

A further significant object of the present invention is directed to providing a band or contact press, particularly useful for a papermaking machine, which affords an enhanced removal of liquid, typically water, from a processed web or the like, with there being provided means which preclude, or at least diminish, the likelihood of again picking-up the liquid or other moisture which previously was expelled from the web.

Now in order to implement these and still further objects of the invention, which will become more readily apparent as the description proceeds, the band press of the present development is manifested by the features that the cylinder possesses a solid closed surface. The fiber web is guided through the press or contact zone in a manner such that it bears upon the cylinder. The press housing is provided at the side where the bands depart from the press housing with an essentially sharp departure or run-off edge by means of which the bands are separated from the paper web which remains in contact with the cylinder.

Since the fiber web, during its passage through the press zone, bears upon the closed surface of the cylinder there is obtained, on the one hand, a positive and reliable web guiding action by virtue of which the fiber web remains adhering to the surface of the cylinder even after lift-off of the bands, and, on the other hand, there is avoided any elongation and shrinkage of the web in the circumferential direction as such, for instance, would arise if the fiber web were located between a felt band and the press band. Due to the separation of the bands from the paper web by means of an essentially sharp edge there is accomplished an immediate separation of the paper web from the bands containing the expressed or pressed-out water upon departure from the press zone. Consequently, there can be beneficially avoided any remoistening or rewatering of the fiber web and there is realised an optimum pressing efficiency or action.

In this regard attention is directed to German patent publication No. 2,108,423 wherein there is disclosed a band press which contains a press shoe. This press shoe is provided with a rounded portion at the location where the paper web in conjunction with the bands departs from the shoe. Also in this case there is strived for a reduction of the undesirable remoistening or rewetting action, which, however, can only be accomplished to an unsatisfactory degree. This is so because, on the one hand, the rounded portion does not afford a sufficiently rapid separation action and, on the other hand, the paper web is guided between the impervious press band and the felt which results in the aforementioned disadvantages for the fiber web, specially paper webs. Additionally, the press shoe which is provided for such prior art band press only forms an extremely short press region or path. This likewise is disadvantageous in terms of an efficient pressing operation.

It is preferable according to the invention to design the press housing so that it contains a plurality of pressure chambers or spaces which, viewed with respect to the direction of movement of the bands, possess progressively increasing pressure therein. In this way there can be obtained an advantageous progressive and protective dewatering of the pressed paper web.

The departure or run-off edge of the press housing can be formed by two flat or planar surfaces which intersect at an angle of at most 170°. This run-off edge can be provided with a rounded portion having a radius of maximum 10 mm , preferably about 1 mm.

The cylinder can be designed in the manner of a controlled deflection roll, also referred to in the papermaking art as a roll with bending or sag compensation, such as, for instance, is known from U.S. Pat. No.

3,802,044 to which reference may be readily had and the disclosure of which is incorporated herein by reference.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a schematic illustration in partial sectional view of a band or contact press constructed according to the invention;

FIG. 2 is an enlarged detail of a portion of the band press shown in FIG. 1;

FIG. 3 is an enlarged detail of the structure shown in FIG. 2;

FIG. 4 is a fragmentary sectional view of one possible construction of the press band; and FIG. 5 is a schematic diagram illustrating the pressure characteristic or course prevailing at the press or contact zone of the band press shown in the arrangement of FIG. 1.

DETAILED DESCRIPTION OF THE PREFERRED EMBODIMENTS

Describing now the drawings, it is to be understood that only enough of the construction of the band or contact press of the present development has been illustrated in order to simplify the showing and as needed for those skilled in this art to readily understand the underlying principles and concepts of this development. Turning attention now to the exemplary embodiment of band press schematically illustrated in FIG. 1 it will be seen that the same contains a cylinder or roll structure 1 and a press or contact housing 2 which conjointly form a press or contact zone A. The paper web 3 or other processed web-like material which is to have the moisture contained therein removed, typically which is to be dewatered, is guided in conjunction with a porous band, for instance a felt 4 and/or wire 5 and a press band 6 which is impervious to water through the press zone A. The press band 6 is guided over suitable guide elements, here shown as guide rolls 7. Comparable guide rolls are provided for the felt band or felt 4 and the wire or sieve band 5 but have not been particularly illustrated in FIG. 1 in order to simplify the showing and because the representation thereof is totally unimportant for understanding the principles of the invention.

As will be further evident by referring to FIG. 1 the press housing 2 is provided with three pressure chambers or spaces 8, 9 and 10. Within these pressure chambers 8, 9 and 10 there prevail the respective pressures $P_1$, $P_2$, $P_3$ of a suitable pressurized fluid medium. This pressurized fluid medium is preferably a liquid, such as water, but of course other fluid mediums can be used such as compressed air.

As previously mentioned the cylinder or roll structure 1 can be constructed in the fashion of a controlled deflection roll, for instance as has been disclosed by way of example and not limitation in the aforementioned U.S. Pat. No. 3,802,044 to which reference may be readily had. This cylinder 1 contains a central support or beam 11 about which there is rotatably mounted a roll shell 12. At the support or beam 11 there are guided hydrostatic pressure elements, here shown in the form of pressure pistons 13 which are exposed to the pressure of a pressurized fluid medium which is infed through a bore or passageway 14 as is well known for such type of controlled deflection rolls. The pressurized fluid medium infed through the bore 14 and acting upon the pressure pistons 13 supports the roll shell 12 against the force of the pressurized fluid medium which is effective within the press housing 2. As to details such as, for instance, the manner in which there is accomplished the hydrostatic lubrication between the pressure or support pistons 13 and the inner surface of the roll shell 12 reference may be had to the aforementioned U.S. Pat. No. 3,802,044.

Now with specific reference to FIG. 2 there is illustrated therein a portion of the band press depicted in FIG. 1 on an enlarged scale. It will be seen that the press housing 2 is provided with a departure or run-off edge 15 at the side where the bands 4, 5 and 6 depart or outbound from the press housing 2. By means of this run-off or departure edge 15 the bands 4, 5 and 6 are separated from the paper web 3 which remains in contact with the cylinder 1.

This run-off edge 15 is formed at a ledge member 16 or equivalent structure, details of which have been shown in sectional view, again on a still larger scale, in FIG. 3. By referring specifically to such FIG. 3 it will be recognized that this run-off edge 15 possesses a minimum radius R which at most amounts to about 10 mm, preferably approximately 1 mm. Additionally, the run-off edge 15 is formed by two intersecting and essentially flat or planar surfaces 17 and 18 which enclose therebetween an angle $\alpha$. This angle, which preferably is an obtuse angle in consideration of reducing the wear, amounts to at most 170°.

As will be seen by referring to FIG. 4 the band 6 which is impervious to the pressurized fluid medium, which is preferably water, can possess openings or also slots generally indicated by reference character 20, for the reception or pick-up of the pressed-out or expressed water.

Finally, FIG. 5 illustrates by way of example an optimum pressure characteristic or course which prevails at the press zone A. It will be apparent that after stepwise increase of the pressures $P_1$, $P_2$ and $P_3$ there appears at the run-off edge 15 a sudden relaxation or pressure drop, and at the same time as will be evident by reverting to FIGS. 1 and 2, the bands 4, 5 and 6 are raised-off of the paper web 3, so that there is practically avoided any remoistening or retro-watering of the previously dewatered paper web.

Although in the exemplary embodiment illustrated in the drawing there are used two porous bands, namely a felt 4 and a wire or sieve 5, in principle it is possible to only provide one of these bands. During the dewatering of a paper web there is used as a general rule, a felt, possibly in conjunction with the wire. However, the band press also can be generally employed as a dewatering device for fiber stock. In particular, in such case there can also only be used a wire or sieve band alone.

In the showing of the drawings the band press is arranged such that a lower quadrant of the cylinder 1 is wrapped by the bands. This arrangement has the advantage that the water which has been pressed-out and contained in the bands is retained in such bands under the action of the force of gravity, so that the remoistening or renewed capture of the water by the processed paper web or otherwise is rendered more difficult. In certain situations, however, it also might be advantageous to resort to a different arrangement, for instance, a reversal of the arrangement illustrated in FIG. 1 wherein, for example, the bands are located at the top of the equipment. With this modified design it would be possible to avoid difficulties which possibly could arise during the removal of the materials which have been scraped-off of the surface of the cylinder 1 by the scraper 30 or equivalent removal instrument.

In the arrangement of FIG. 1 it will be recalled that the cylinder 1 has been illustrated and described as constituting a controlled deflection roll, for instance, constructed in the manner disclosed in the aforementioned U.S. Pat. No. 3,802,044. However, it should be expressly understood that a different random construction of controlled deflection roll or even a simple roll not structured for compensating for bending or sag can be used.

While there are shown and described present preferred embodiments of the invention, it is to be distinctly understood that the invention is not limited thereto, but may be otherwise variously embodied and practiced within the scope of the following claims. Accordingly,

What I claim is:

1. A band press for a fiber web, for instance a paper web comprising:

a cylinder;

means defining a press housing which extends along a portion of the circumference of the cylinder;

said press housing containing at least one pressure chamber for a pressurized fluid medium;

said cylinder and said press housing being arranged in coacting relationship with respect to one another such that there is formed therebetween a press zone;

at least one porous band for taking-up liquid expressed from the fiber web which is being processed;

a press band which is impervious for the pressurized fluid medium in the pressure chamber;

the fiber web from which the liquid contained therein is to be removed together with said at least one porous band and said press band being guided through said press zone;

said cylinder possessing a solid closed surface;

said fiber web being guided through the press zone such that said fiber web bears against said solid closed surface of said cylinder;

means provided for said press housing at a side thereof where the bands depart from said press housing so as to define an essentially sharp run-off edge by means of which the bands are separated from the fiber web immediately following the press zone at a location where there is a reduction in pressure and wherein immediately after said sharp run-off edge the fiber web continues to travel while in contact with the solid closed surface of the cylinder;

said run-off edge of said press housing being formed by two substantially planar surfaces which intersect one another at a predetermined angle which does not exceed 170°; and said run-off edge possesses a rounded portion having a radius of at most 10 mm.

2. The band press as defined in claim 1, wherein:

said press housing contains a plurality of said pressure chambers which, viewed with respect to the direction of movement of said bands, possesses progressively increasing pressure conditions therein.

3. The band press as defined in claim 1, wherein:

said radius amounts to about 1 mm.

4. The band press as defined in claim 1, wherein:

said cylinder is structured to define a controlled deflection roll.

* * * * *